United States Patent [19]

Bresnyan

[11] 4,173,801

[45] Nov. 13, 1979

[54] APPARATUS FOR FLUSHING TOILETS

[76] Inventor: Nicholas P. Bresnyan, 214 Candlewood Rd., Groton, Conn. 06340

[21] Appl. No.: 918,679

[22] Filed: Jun. 23, 1978

[51] Int. Cl.[2] ..... E03D 1/14; E03D 3/12

[52] U.S. Cl. ..... 4/326; 4/324; 4/405; 4/249

[58] Field of Search ..... 4/326, 249, 325, 324, 4/327, 415

[56] References Cited

U.S. PATENT DOCUMENTS

| | | | |
|---|---|---|---|
| 2,237,294 | 4/1941 | Easley | 4/326 |
| 2,731,647 | 1/1956 | Groth et al. | 4/326 |
| 3,067,432 | 12/1962 | New | 4/324 |
| 3,909,856 | 10/1975 | Dunn, Jr. | 4/326 |
| 4,003,097 | 1/1977 | Book | 4/326 |
| 4,011,604 | 3/1977 | Goldworthy | 4/326 |
| 4,096,591 | 6/1978 | Awis | 4/326 |

*Primary Examiner*—Henry K. Artis
*Attorney, Agent, or Firm*—Albert W. Hilburger

[57] ABSTRACT

A double valve construction selectively provides a full flush or a partial flush from the tank of a toilet. The apparatus, which may be utilized to modify existing toilet water closets, includes a manifold mounted on the tank in communication with an outlet for draining water from the tank. The manifold includes a pair of valve seats, one located proximate to the bottom of the tank and one located distant from the bottom of the tank. An actuating mechanism selectively operates a pair of valves associated with the valve seats and is so arranged that when an operating handle is turned in one direction, it disengages the upper valve from the upper valve seat for a partial flush and when the operating handle is moved in the opposite direction, it disengages the lower valve from the lower valve seat for a full flush.

12 Claims, 7 Drawing Figures

APPARATUS FOR FLUSHING TOILETS

BACKGROUND OF THE INVENTION

1. Field of Invention

This invention relates generally to improvements in toilet flush apparatus and, more particularly, to those improvements which enable, selectively, either a full flush or a partial flush of the water in the flush tank.

2. Description of the Prior Art

In recent years, it has become more and more apparent that our natural resources are not as plentiful as they were once believed to be. It came to be realized that even water, one of our most plentiful of natural resources, was becoming threatened. As a result, efforts began to conserve more natural resources, including water. It also came to be realized that one device, in particular, utilized daily by individuals, namely a toilet, consumes very large amounts of water in its operation. Although a full capacity of the flush tank for a toilet may be necessary in order to dispose of solid wastes, a much smaller quantity of flush water is effective to dispose of liquid wastes. Hence, if a toilet performs a full flush even when disposing of liquid wastes, the consumption of water in the disposal process is unnecessary and excessive. When such excessive usage by an individual is multiplied by the size of the population, it can be appreciated that the quantity of water used needlessly in a day's time is very great indeed.

When concerned people first came to realize this situation, it was not unusual for them to place bricks, rocks, or other water displacing articles in the flush tank to thereby reduce the volume of water available for a flush. It also came to be known to place weirs or dams in the flush tank surrounding the outlet valve, similarly for the purpose of reducing the volume of water in the tank available for flushing. Such constructions are disclosed in U.S. Pat. Nos. 3,259,918 and 3,731,324, which recite the common problems of securing and sealing the weirs or dams within the flush tank.

Another proposed solution is disclosed in U.S. Pat. No. 3,939,507 in which a cylindrical tube is placed atop the outlet to raise the minimum water level in the tank and thereby reduce the volume of water discharged during flushing. The cylindrical tube is intended to be a permanent arrangement similar to the weirs or dams previously discussed.

Also known to the applicant is the U.S. Pat. No. 1,718,744 which discloses the use of a weight to close the outlet valve upon release of the operating handle such that a minimal amount of water is discharged in the process of flushing the toilet.

Those patents known to the applicant which may be considered noteworthy as being structurally similar to the present invention are U.S. Pat. Nos. 2,731,647, 2,803,833, 3,909,856, and 4,003,097. However, in each instance, the interior structure of an existing or conventional water closet would have to be drastically altered, and, unlike with the application of the present invention, would generally require the services of a professional plumber. For example, in substantially all of the patents cited, it would be necessary to remove the preexisting outlet or spud valve in order to accommodate the structure disclosed in the patent. Furthermore, in many instances, the prior art has disclosed complex constructions which are expensive to manufacture and maintain and which are not readily applicable to existing flush tanks.

SUMMARY OF THE INVENTION

It was with recognition of these problems and the state of the prior art that the present invention was conceived. Thus, the present invention discloses a double valve construction which selectively provides either a full flush or a partial flush from the flush tank of a toilet, as desired. The apparatus, which may be utilized to modify existing toilet water closets, includes a manifold mounted on the tank in communication with an outlet for draining water from the flush tank. The manifold includes a pair of valve seats, one located proximate to the bottom of the tank and one located distant from the bottom of the tank. An actuating mechanism selectively operates a pair of valves associated with the valve seats and is so arranged that when an operating handle is turned in one direction, it disengages the upper valve from the upper valve seat for a partial flush and when the operating handle is moved in the opposite direction, it disengages the lower valve from the lower valve seat for a full flush.

As compared with many of the patents known to the prior art, the present invention embodies a simplified construction and utilizes a minimum number of parts in its construction. Furthermore, the invention utilizes existing materials and components. A major benefit of the invention is that it can be applied to existing flush tanks by an individual who has no particular expertise in the field of plumbing.

An additional benefit of the invention resides in its adjustability by reason of which the volume of water consumed for a full flush can be adjusted according to the specific needs of the user.

Another feature of the present invention resides in its construction whereby positive connections are provided between the valves and the operating handle during operation either in the full flush mode or in the partial flush mode.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings, which are incorporated in and constitute a part of this invention, illustrate one embodiment of the invention, and together with the description, serve to explain the principles of the invention.

DESCRIPTION OF THE PREFERRED EMBODIMENTS

Figure 1:
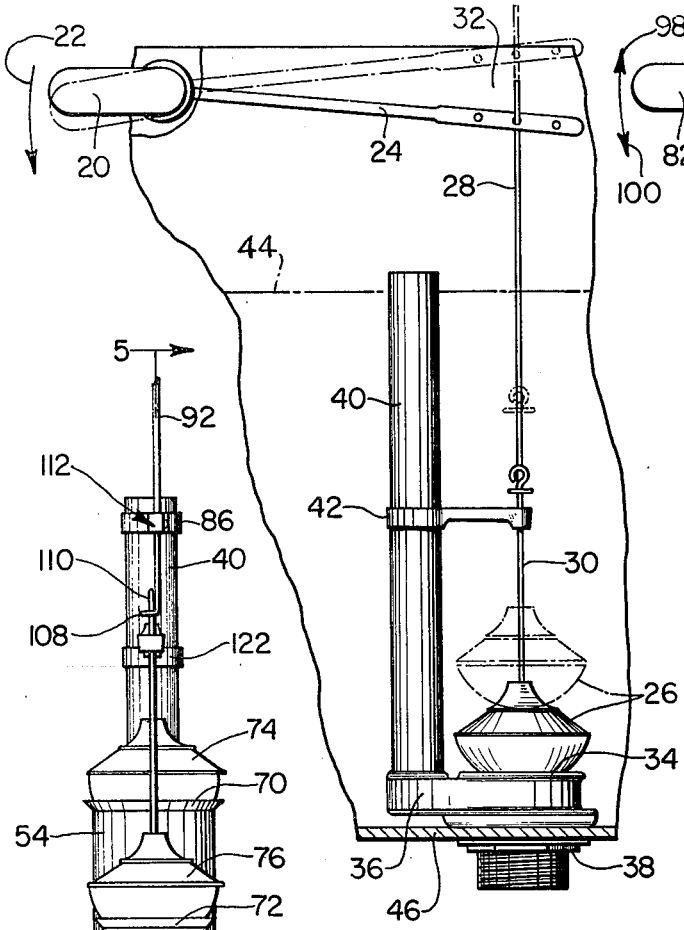
FIG. 1 is a detail front elevation view illustrating a portion of a flush tank known to the prior art, certain parts being cut away and shown in section and certain parts being shown in phantom in order to show a different position of those same parts illustrated by solid lines.

Refer now to the drawings and initially to FIG. 1 which is generally illustrative of the prior art. Thus, according to the known construction, when a toilet is flushed, a flush handle 20 is moved manually in the direction of an arrow 22 and similarly rotates a trip lever 24 thereby raising a tank valve 26 via lift wires 28 and 30 from a solid line position to a dotted line position.

The solid line position of the tank valve 26 represents a closed position preventing escape of water from a flush tank 32 as the tank valve 26 rests on a valve seat 34 of a hollow support member 36. The support member 36 is suitably mounted to the bottom of the flush tank 32 by means of a lock nut 38. A standpipe or overflow tube 40 is threadedly mounted at its lower end to the support member 36 and is in communication with the support member to prevent water within the flush tank 32 from overflowing the top of the tank. A bracket 42 is suitably mounted on the overflow tube 40 and is suitably apertured distant from the tube to appropriately guide the lift wire 30 as it is moved between its lowered and raised positions. The tank valve 26 is suitably provided with some measure of buoyancy so that, once lifted from the valve seat 34, it remains disengaged from the valve seat until the water in the flush tank 32 has been lowered from a full condition as represented by a center line 44 to a level approximately in the plane of the valve seat 34. When the tank 32 is then nearly empty, the tank valve 26 falls back into place in engagement with the valve seat 34 and prevents any further flow of water from the tank via the support member 36.

The invention is an improvement over the construction illustrated in FIG. 1. In accordance with the invention, apparatus for flushing a toilet comprises: a tank capable of being filled with water including a bottom and sidewalls; a hollow support member mounted on said tank including structure defining an outlet at the bottom of the tank for draining water therefrom; a manifold mounted on said support member including a first valve seat distant from the bottom of said tank and a second valve seat proximate to the bottom of said tank, said first and second valve seats both communicating through said manifold with the outlet; and a hollow standpipe mounted on said support member and extending upwardly therefrom, the interior of said standpipe being in communication with the outlet.

Figure 2:
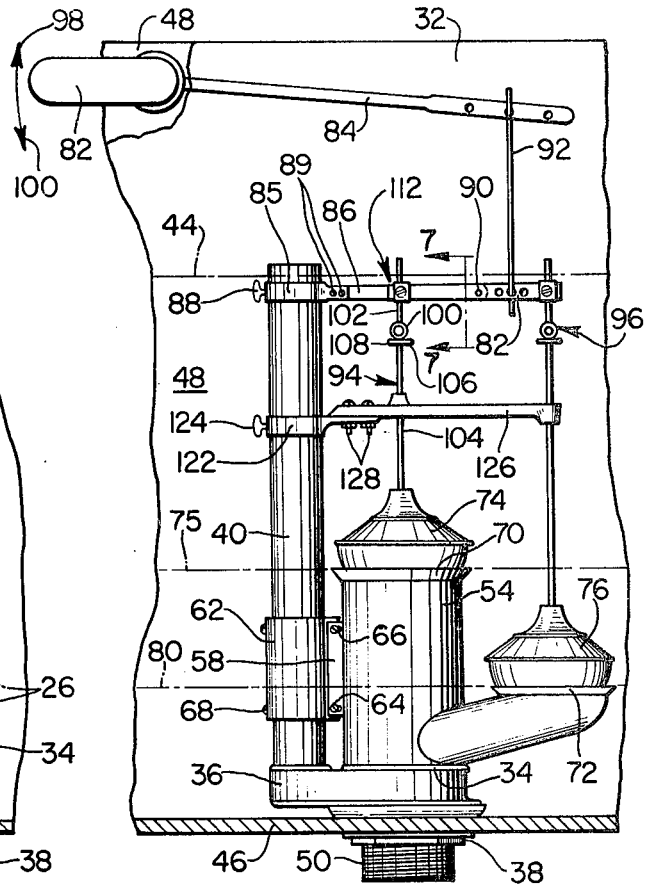
FIG. 2 is a detail front elevation view illustrating the interior of a flush tank incorporating the principles of the present invention, with all parts assuming a relaxed or normal position, certain parts being cut away and shown in section.
Figure 3:
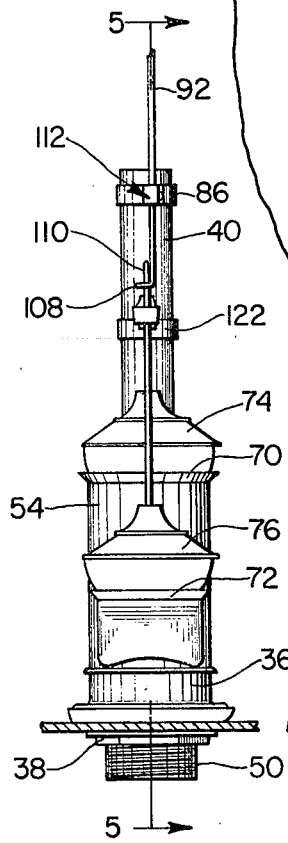
FIG. 3 is a detail side elevation view of the construction illustrated in FIG. 2.
Figure 4:
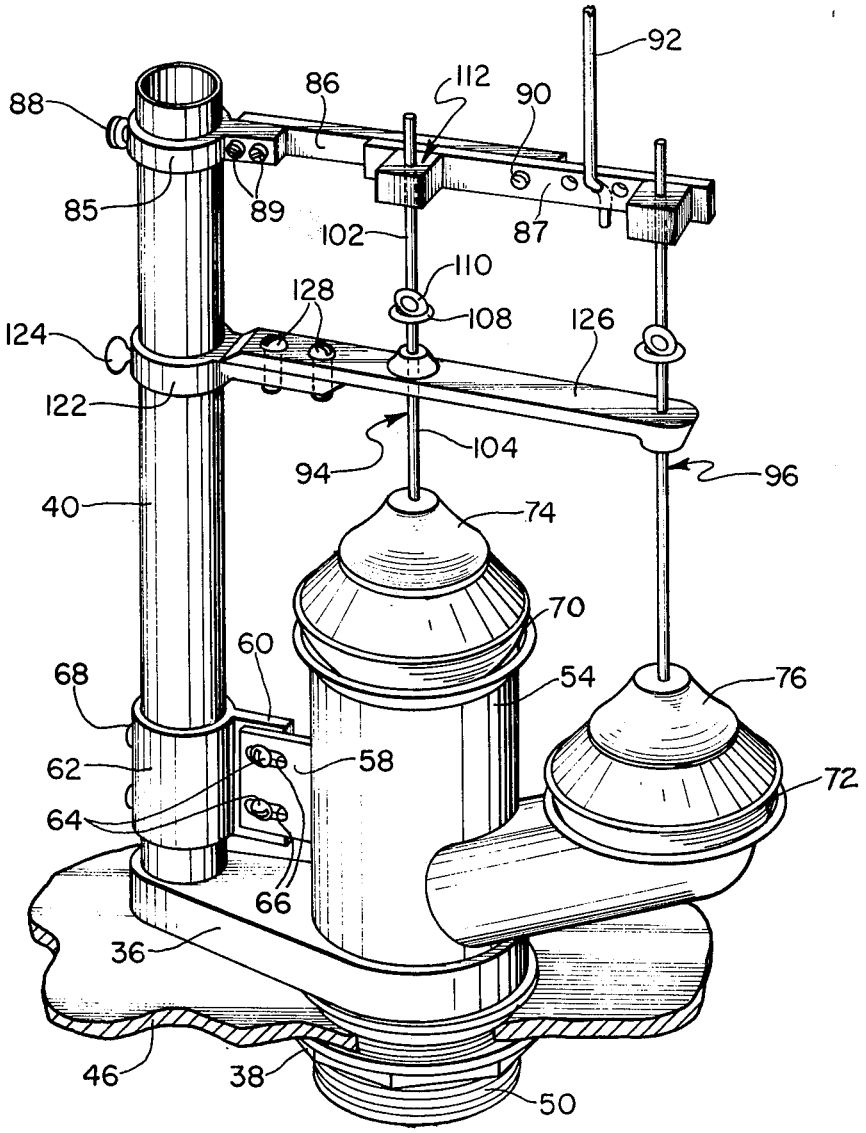
FIG. 4 is a perspective view of the construction illustrated in FIGS. 2 and 3, certain parts being cut away and shown in section.

As embodied herein, and with particular reference initially to FIGS. 2–4, the tank 32 of the invention may be similar in all respects, if desired, to the tank already described with respect to FIG. 1. As such, it includes a bottom 46 and a plurality of sidewalls 48 to support a quantity of water, the upper level of which may similarly be represented by the center line 44. The hollow support member 36 may also be similar in all respects, if desired, to the support member 36 already described with respect to FIG. 1, and includes an integral fitting 50 which extends through a suitable opening in the bottom 46 of the tank 32. Together with the lock nut 38, the fitting serves to fix the support member 36 to the bottom 46. The fitting 50 also defines an outlet at the bottom of the tank which enables water to be drained from the tank.

As previously described, the member 36 is formed with a valve seat 34 adjacent the bottom of the tank 32 and since the support member 36 is hollow, the valve seat 34 communicates with the outlet defined by the fitting 50. However, in accordance with the present invention, the valve seat 34 merely serves as structure to fittingly receive and support a base 52 of the manifold 54 (see FIGS. 5 and 6). To assure the watertight integrity of the connection between the base 52 and the valve seat 34, a gasket 56 of suitable resilient material may be employed. Furthermore, in order to insure the structural integrity of that unit of the invention including the manifold 54, the support member 36, and the overflow tube 40, a bracket 58 integral with the manifold 54 and extending radially outwardly therefrom cooperates with a similar bracket 60 integral with a sleeve 62 mounted on the overflow tube 40. Suitable fasteners 64 extend through elongated openings 66 in the bracket 58 and cooperating openings in the bracket 60. The elongated openings 66 permit lateral positioning of the manifold 54 to assure the proper positioning of the base 52 on the valve seat 34. At such time that the manifold 54 is properly positioned on the support member 36, the fasteners 64 may be tightened together with fasteners 68 serving to secure the sleeve 62 against longitudinal movement relative to the overflow tube 40. The manifold 54 includes a first or upper valve seat 70 distant from the bottom 46 of the tank 32 and a second or lower valve seat 72 which is proximate to the bottom of the tank 32. Viewing FIGS. 5 and 6, it is seen that both the first and second valve seats communicate through the manifold with the outlet defined by the fitting 50.

At a location proximate to the valve seat 34, the overflow tube 40 may be threadedly mounted to the support member 36 or may be mounted in any other suitable fashion. Being hollow, the interior of the overflow tube 40 is in communication with the interior of the support member 36 and thereby with the outlet defined by the fitting 50. During normal operation, the overflow tube 40 serves to prevent the level of the water within the tank 32 from reaching a level higher than its uppermost end. Specifically, should the level of the water tend to rise above the upper end of the overflow tube 40, the water would flow into the tube and be discharged through the fitting 50. As a practical matter, then, the upper end of the overflow tube 40 defines the upper limit of the water level within the flush tank 32.

Figure 5:
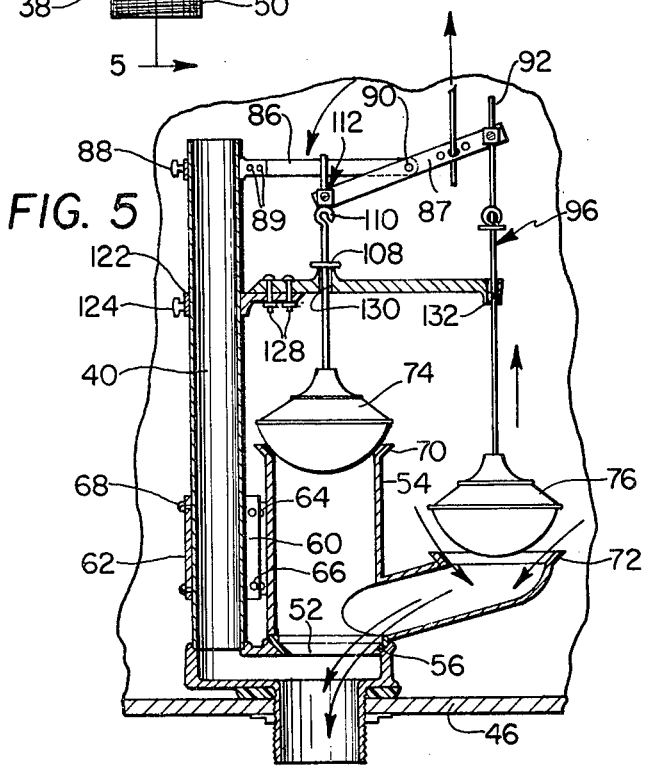
FIG. 5 is a cross-section view taken generally along line 5—5 in FIG. 3 and illustrating that mode of operation of the invention resulting in a full flush.

In accordance with the invention, a first valve is movable between a closed position engageable with said first valve seat to prevent the flow of water out of said tank through the outlet and an open position spaced from said first valve seat to permit the flow of water out of said tank through the outlet; and a second valve is movable between a closed position engageable with said second valve seat to prevent the flow of water out of said tank through the outlet and an open position spaced from second valve seat to permit the flow of water out of said tank throuh the outlet. As embodied herein, with particular attention to FIGS. 5 and 6, a first or upper valve 74 is movable between a closed position (FIG. 5)

engageable with the valve seat 70 to prevent the flow of water out of the tank 32 through the outlet defined by the fitting 50. When the upper valve 74 has been raised to an open position (FIG. 6) spaced from the valve seat 70, water is permitted to flow out of the tank 32 through the manifold 54 and through the outlet defined by the fitting 50. This mode of operation is defined as a partial flush and enables the water within the tank 32 to reduce its volume down to a level as indicated by a center line 75 (See FIG. 2) which lies generally in a plane of the valve seat 70. Similarly, a second or lower valve 76 is movable between a closed position (FIG. 6) engageable with the valve seat 72 to prevent the flow of water out of the tank 32, and an open position (FIG. 5) spaced from the valve seat 72 to permit the flow of water out of the tank through the outlet defined by the fitting 50. In the mode illustrated in FIG. 5, the level of water in the tank 32 can be decreased to a level as indicated by a center line 80 (See FIG. 2) which lies generally in a plane of the valve seat 72. This mode is generally referred to as a full flush.

It will be appreciated that the valves 74 and 76 and their associated valve seats 70 and 72 are chosen of materials and properly fabricated so as to assure a tight mating fit when in the closed position in order to prevent any flow of water from the tank 32. The valves 74 and 76 may, if desired, be of a conventional construction such as the valve 26 (see FIG. 1), being composed of rubber or some other suitable resilient material. Furthermore, as with the conventional valve 26, the valves 74 and 76 may have some measure of buoyancy such that when a flush sequence is initiated and a valve is lifted from its associated valve seat, it will remain free and clear of its associated valve seat until the level of water has diminished to the level of its associated valve seat.

In accordance with the invention, a handle is pivotally mounted on a sidewall of said tank; a first actuating lever is fixed at one end of said handle; a second actuating lever is provided; a pivot means rotatably mounts said second actuating lever at a location distant from said standpipe; a link pivotally connects said first and second actuating levers; a first lift wire means pivotally connects said first valve and said second actuating lever at one side of said pivot means; and second lift wire means pivotally connects said second valve and said second actuating lever at an opposite side of said pivot means, whereby rotation of said handle in one direction serves to move said first valve to an open position while maintaining said second valve in a closed position, and rotation of said handle in the opposite direction serves to move said second valve to an open position while maintaining said first valve in a closed position.

As embodied herein, and with particular reference initially to FIG. 2, a sequence of operations resulting in a flush is initiated by a handle 82 which is pivotally mounted on a sidewall 48 of the tank 32 but is external of the tank for operation by a user. A first actuating lever 84 which may be similar to the lever 24 (FIG. 1) is fixed at one end to the handle 82 and extends within the tank 32 and thereby serves as an extension of the handle 82. A clamp 85 encircles the overflow tube 40 adjacent its upper end. A cantilevered member 86 shown in FIG. 2 extends radially outwardly from the overflow tube 40 and serves to support a second actuating lever 87 at a location distant from the overflow tube 40. The cantilevered member 86 and its associated clamp 85 may be adjustably secured to the overflow tube 40 by means of a set screw 88 and suitable fasteners 87 may be employed to laterally position the member 86 in relation to the clamp 85. A suitable pivotal connection 90 is provided substantially midway between the ends of the lever 87 at an extremity of the cantilevered member 86 to assure freedom of movement of the lever 87 relative to the member 86.

A suitable link 92 is provided to connect the actuating levers 84 and 87, the link 92 being attached to the actuating lever 87 intermediate the pivotal connection 90 and an end of the lever 87. The link 92 is connected, respectively, to the levers 84 and 87 in any suitable fashion to enable relative pivotal motion between the components.

In order to operatively connect the operating handle 82 and the valves to effect a flush, it is seen, with continuing reference to FIG. 2, that a first lift wire mechanism 94 connects the first valve 74 and the actuating lever 87 at a location to one side of the pivotal connection 90, that is, generally intermediate of the connection 90 and the overflow tube 40. Similarly, a second lift wire mechanism 96 pivotally connects the second valve 76 and the lever 87 at an opposite side of the pivotal connection 90, that is, on the side distant from the overflow tube 40.

Figure 6:
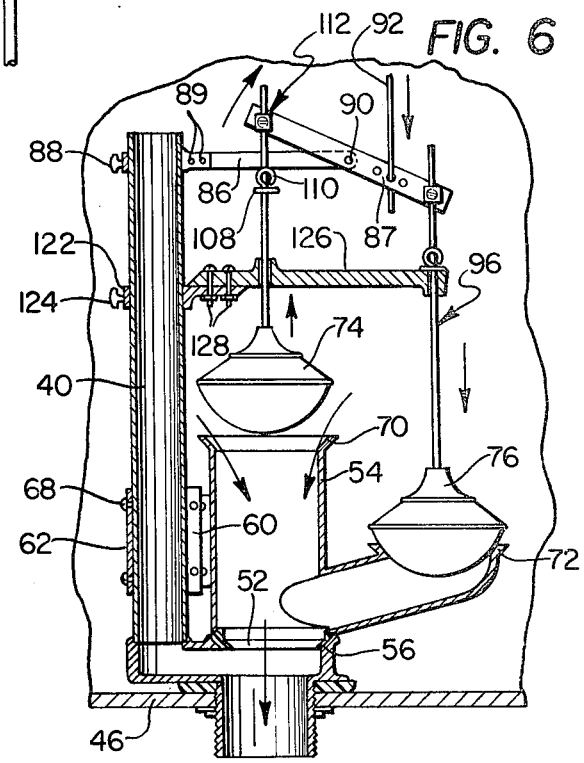
FIG. 6 is a cross-section view similar to FIG. 5 illustrating that mode of operation of the invention resulting in a partial flush.

Thus, as the operating handle 82 is rotated in the direction of an arrow head 98, the link 92 is lowered thereby rotating the actuating lever 87 to the position illustrated in FIG. 6. In this manner, the lower valve 76 is maintained in a closed position while the upper valve 74 is raised to an open position with the result that a partial flush of the tank 32 is achieved.

Similarly, when the operating handle 82 is rotated in the direction of an arrow head 100, the link 92 is lifted and the lever 87 is pivoted to the position as illustrated in FIG. 5. When this occurs, the upper valve 74 is maintained in a closed position while the lower valve 76 is raised to its open position such that a full flush is achieved.

In accordance with the invention, the apparatus is generally as previously described wherein said first lift wire means includes an upper lift wire, a lower lift wire, and a lost motion connection between its associated said upper and lower lift wires. As embodied herein, the lift wire mechanism 94 includes an upper lift wire 102 which is pivotally connected to the actuating lever 87, a lower lift wire 104 which is suitably connected, as by threads, to the valve 74, and a lost motion connection 106 (FIG. 2) between the upper and lower lift wires. One suitable construction for the connection 106 may be accomplished by forming an eye 108 at the lower end of the lift wire 102 which receives the shank of the lift wire 104 through it. Then, at its upper end, the lift wire 104 may be formed with a loop 110 having a diameter similar to that of the eye 108 restraining the lift wires 102 and 104 from motion in opposite directions when the eye 108 and loop 110 are engaged. At the same time, the construction permits the eye and loop to become disengaged and the lift wires 102 and 104 to move longitudinally in opposite direction such that they become more and more coextensive, as well as to permit their universal movement. In this fashion, when the handle 82 is moved in the direction of the arrow head 98 so as to open the valve 74 (FIG. 6), the eye 108 and the loop 110 of the connection 106 are engaged such that the lift wire mechanism 94 is fully extended. At the same time, the lift wire mechanism 96 which is similarly constructed but for which additional reference numerals have not been applied to the drawings for reasons of clarity, the lift wire mechanism 96 is in a retracted position and the valve 76 is maintained in the closed position.

Figure 7:
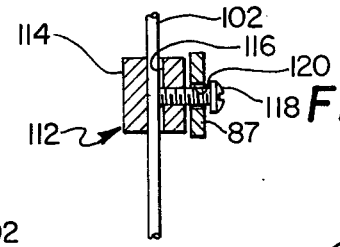
FIG. 7 is a detail cross-section view taken generally along line 7—7 in FIG. 2.

In accordance with the invention, the apparatus is generally as previously described wherein said lift wire means includes adjustment means for adjusting the height of said associated upper lift wire relative to the bottom of said tank. As embodied herein, with particular reference to FIG. 7, an adjustment device generally indicated by the reference numeral 112 is shown applied to the upper lift wire 102 of the first lift wire mechanism 94. However, it will be understood that the adjustment device 112 is identical in its construction and operation whether it is applied to the lift wire mechanism 94 or to the lift wire mechanism 96. Accordingly, any reference to the former lift wire shall also be appropriate as a reference to the latter lift wire. As seen in FIG. 7, the adjustment device includes a block 114 which has a suitable bore 116 extending through it. The lift wire 102 is slideably received through the bore 116 and a screw 118 which is threadedly engaged with the block 114 also passes through a clearance hole 120 in the actuating lever 87. The free end of the screw 118 is engageable with the lift wire 102 as it is tightened to hold the device 112 relative to the lift wire 102 and by loosening the screw 118, the device 112 can once again be free to slide longitudinally of the lift wire 102. It is noteworthy that when the screw 118 engages the lift wire 102, there remains sufficient clearance between the head of the screw 118 and the block 114 so that the actuating lever 87 has freedom of movement pivotally on the threaded portion of the screw 118. In this manner, the adjustment device 112 serves to allow adjustment of the actuating lever 87 relative to the lift wire mechanisms as, for example, during installation, and thereafter allows pivotal motion between the lever 87 and the lift wire mechanisms.

It will be appreciated that although the adjustment device 112 has been described as a connection between the lift wire mechanisms 94 and 96, it may just as appropriately be employed as a connection between the link 92 and the actuating lever 87.

In accordance with the invention, the apparatus is generally as previously described wherein guide means are mounted on said standpipe and extend radially outwardly therefrom, and are apertured at a location distant from said standpipe for slidingly receiving therethrough said lower lift wire of said lift wire means. As embodied herein, and with continuing reference of FIGS. 2, 4, 5 and 6, a bracket 122 encircles the overflow tube 40 and can be releasably secured by means of a thumb screw 124. A guide arm 126 is releasably secured to the bracket 122 as, for example, by a pair of suitable fasteners 128 which allow the guide arm 126 to extend outwardly of the overflow tube 40 in its cantilevered fashion. Additionally, there is sufficient clearance between the fasteners 128 and the holes receiving the fasteners through the guide arm 126 for adjustment of the guide arm 126. Clearance holes 130 and 132 in the guide arm 126 serve to slideably receive the lift wire mechanisms 94 and 96, respectively, and the guide arm 126 is positioned relative to the bracket 122 to assure that no binding occurs. Thus, the guide arm 126 serves to provide support for and to guide the lift wire mechanisms 94 and 96 as they travel between the position indicated in FIG. 5 and that indicated in FIG. 6.

The operation of the invention will now be described. In its relaxed state, the tank 32 is filled with water essentially to the level of the center line 44 as illustrated in FIG. 2. When it comes time to flush solid wastes from the toilet, the handle 82 can be rotated in the direction of the arrow head 100 (FIG. 2) thereby causing the valve 76 to be lifted from the valve seat 72 permitting the discharge of water from the tank through the outlet defined by the fitting 50 (see FIG. 5). The buoyancy in the valve 76 assures that the valve will not fall back on to the valve seat 72 until the water level in the tank has descended substantially to the level indicated by the center line 80 (FIG. 2).

When it is desired to discharge liquid wastes from the toilet, the handle 82 is rotated in the direction of the arrow head 98 to the position illustrated in FIG. 6. When this occurs, the valve 74 is raised above its associated valve seat 70. In this manner, the water in the tank 32 flows out through the manifold 54 and the outlet defined by the fitting 50 until such time that the water substantially assumes a level defined by the center line 75 (FIG. 2).

It will be appreciated that the invention may be provided as an entire pre-assembled unit in the form illustrated in FIG. 2. In this form, modification of the prior art construction of FIG. 1 is a simple task. Specifically, it is only necessary to remove valve 26 and lift wires 28 and 30 from the lever 24 and remove the bracket 42 from the existing standpipe 40. Thereupon, the pre-assembled unit is easily installed by sliding the sleeve 62 onto the standpipe 40 and mounting the manifold 54 on to the previous valve seat 34 of the support member 36. The bracket 122 and the cantilevered member 86 with all of their associated components, already described, are then appropriately received within the tank 32 and adjusted so that they operate in the proper fashion.

Thus, by the mere use of a screwdriver, a person with a minimum of mechanical skill can modify a conventional water closet to incorporate the structure and features of the present invention.

The invention in its broader aspects is not limited to the specific details shown and described; departures may be made from such details without departing from the principles of the invention and without sacrificing its chief advantages.

What is claimed is:

1. In combination with a toilet including a tank capable of being filled with water having a bottom and sidewalls, a hollow support member mounted on the tank including structure defining an outlet at the bottom of the tank for draining water therefrom, and a hollow standpipe mounted on said support member and extending upwardly therefrom, the interior of said standpipe being in communication through said support member with the outlet, the improvement comprising:

a manifold mounted on said support member having an interior in communication with the outlet and including a first valve seat distant from the bottom of the tank and a second valve seat proximate to the bottom of the tank;

a first valve movable between a closed position engageable with said first valve seat to prevent the flow of water out of the tank through the outlet and an open position spaced from said first valve seat to permit the flow of water out of the tank through the outlet;

a second valve movable between a closed position engageable with said second valve seat to prevent the flow of water out of the tank through the outlet and an open position spaced from said second valve seat to permit the flow of water out of the tank through the outlet;

a handle pivotally mounted on a sidewall of the tank;

a first actuating lever fixed at one end to said handle;

a second actuating lever;

a cantilevered member lying generally in a plane of said first actuating lever and mounted on said standpipe and extending outwardly therefrom;

pivot means rotatably mounting said second actuating lever on said cantilevered member at a location distant from the standpipe;

a link pivotally connecting said first and second actuating levers;

first lift wire means pivotally connecting said first valve and said second actuating lever at one side of said pivot means; and second lift wire means pivotally connecting said second valve and said second actuating lever at an opposite side of said pivot means whereby rotation of said handle in one direction serves to move said first valve to an open position while maintaining said second valve in a closed position, and rotation of said handle in the opposite direction serves to move said second valve to an open position while maintaining said first valve in a closed position.

2. Apparatus as set forth in claim 1 wherein said first and second lift wire means each includes an upper lift wire, a lower lift wire, and a lost motion connection between its associated said upper and lower lift wires.

3. Apparatus as set forth in claim 2 wherein said first and second lift wire means each includes adjustment means for adjusting the height of said associated upper lift wire relative to the bottom of said tank.

4. Apparatus as set forth in claim 2 including a bracket mounted on said standpipe and extending radially outwardly therefrom, and being apertured at locations distant from said standpipe for slidingly receiving therethrough said lower lift wires of said first and second lift wire means.

5. Apparatus for flushing a toilet comprising:

a tank capable of being filled with water including a bottom and sidewalls;

a hollow support member mounted on said tank including structure defining an outlet at the bottom of the tank for draining water therefrom;

a manifold mounted on said support member including a first valve seat distant from the bottom of said tank and a second valve seat proximate to the bottom of said tank, said first and second valve seats both communicating through said manifold with the outlet;

a hollow standpipe mounted on said support member and extending upwardly therefrom, the interior of said standpipe being in communication with the outlet;

a first valve movable between a closed position engageable with said first valve seat to prevent the flow of water out of said tank through the outlet and an open position spaced from said first valve seat to permit the flow of water out of said tank through the outlet;

a second valve movable between a closed position engageable with said second valve seat to prevent the flow of water out of said tank through the outlet and an open position spaced from said second valve seat to permit the flow of water out of said tank through the outlet;

a handle pivotally mounted on a sidewall of said tank;

a first actuating lever fixed at one end to said handle;

a second actuating lever;

a cantilevered member lying generally in a plane of said first actuating lever and mounted on the standpoint and extending outwardly therefrom;

pivot means rotatably mounting said second actuating lever on said cantilevered member at a location distant from said standpipe;

a link pivotally connecting said first and second actuating levers;

a first lift wire means pivotally connecting said first valve and said second actuating lever at one side of said pivot means; and second lift wire means pivotally connecting said second valve and said second actuating lever at an opposite side of said pivot means, whereby rotation of said handle in one direction serves to move said first valve to an open position while maintaining said second valve in a closed position, and rotation of said handle in the opposite direction serves to move said second valve to an open position while maintaining said first valve in a closed position.

6. Apparatus as set forth in claim 5 wherein said first and second lift wire means each includes an upper lift wire, a lower lift wire, and a lost motion connection between its associated said upper and lower lift wires.

7. Apparatus as set forth in claim 6 wherein said first and second lift wire means each includes adjustment means for adjusting the height of said associated upper lift wire relative to the bottom of said tank.

8. Apparatus as set forth in claim 6 including guide means mounted on said standpipe and extending radially outwardly therefrom, and being apertured at locations distant from said standpipe for slidingly receiving therethrough said lower lift wire of said first and second lift wire means.

9. Apparatus as set forth in claim 3 wherein said adjustment means includes a block having a suitable bore therethrough for slideable reception of said upper lift wire, a screw pivotally mounted on said actuating lever and threadedly engaged with said block, said screw being selectively engageable with said upper lift wire to releasably secure said block to said upper lift wire.

10. Apparatus as set forth in claim 7 wherein said adjustment means includes a block having a suitable bore therethrough for slideable reception of said upper lift wire, a screw pivotally mounted on said actuating lever and threadedly engaged with said block, said screw being selectively engageable with said upper lift wire to releasably secure said block to said upper lift wire.

11. Apparatus as set forth in claim 1 including adjustment means interconnecting said link and said second actuating lever for selectively adjusting the length of said link between said first and second actuating levers.

12. Apparatus as set forth in claim 5 including adjustment means interconnecting said link and said second actuating lever for selectively adjusting the length of said link between said first and second actuating levers.

* * * * *